United States Patent [19]

Fox et al.

[11] Patent Number: 5,010,441

[45] Date of Patent: Apr. 23, 1991

[54] GROUNDING BRUSH

[75] Inventors: Elizabeth D. Fox, Rochester; Alan G. Schlageter, Ontario, both of N.Y.

[73] Assignee: Xerox Corporation, Stamford, Conn.

[21] Appl. No.: 469,873

[22] Filed: Jan. 24, 1990

[51] Int. Cl.[5] ..... H05F 3/02; G03G 21/00

[52] U.S. Cl. ..... 361/221; 361/220; 361/214; 355/219

[58] Field of Search ..... 361/221, 220, 214, 212; 355/219

[56] References Cited

U.S. PATENT DOCUMENTS 4,494,166 1/1985 Billings et al. ..... 361/214

4,771,360 9/1988 Ayash ..... 361/221

*Primary Examiner*—A. D. Pellinen

*Assistant Examiner*—Brian Johannsen

*Attorney, Agent, or Firm*—H. Fleischer; J. E. Beck; R. Zibelli

[57] ABSTRACT

A device which electrically grounds a rotating shaft. A brush is mounted removably on the rotating shaft. The brush has conductive fibers extending outwardly over a portion thereof. As the shaft rotates, the conductive fibers of the brush periodically contact an electrically grounded member to electrically ground the shaft.

10 Claims, 2 Drawing Sheets

GROUNDING BRUSH

This invention relates generally to an electrophotographic printing machine, and more particuarly concerns a device for electrically grounding rotating shafts employed therein.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In a commercial printing machine of the foregoing type, many of the various components use rotating shafts. Static electrical charges are generated on a dielectric web or sheet material by contact with charged rollers or webs or by frictional contact with guide surfaces necessary to transport it through a handling apparatus. The build-up of these charged can be a severe problem. Such static electrical charges can cause the conveyed material to be attracted to other like material or to portions of the handling apparatus. This results in the failure of the apparatus to function properly. Additionally, when static electrical charges are present, a sheet or web may attract dust or may present a dangerous annoyance to an operator. In order to minimize this problem it is necessary to electrically ground the rotating shaft rather than allowing it to float electrically. Many types of devices have been used to electrically ground rotating shafts. Generally, this is accomplished by hardware mounted fixedly on the shaft to provide an electrical ground path for the shaft. This increases the complexity and manufacturing cost of the printing machine. Furthermore, the cost of maintaining the printing machine in the customer's facility is also increased. Accordingly, it is highly desirable to be capable of reducing the complexity and cost of electrically grounding rotating shafts used in printing machines.

Various types of electrical grounding brushes have been devised. The following patents appear to be relevant:

| | |
|---|---|
| US-A-4,494,166 | |
| Patentee: | Billings et al. |
| Issued: | January 15, 1985 |
| US-A-4,771,360 | |
| Patentee: | Ayash |
| Issued: | September 13, 1988 |

The relevant portions of the foregoing patents may be summarized as follows:

U.S. Pat. No. 4,494,166 discloses an electrophotographic printing machine having at least two electrically grounded carbon brushes that discharge static electricity from sheets moving through the printing machine. The brushes are mounted such that one brush contacts sheets moving through the machine while the other brush remains spaced from the sheets in order to minimize fluctuations in static reduction over the machine life. The brushes are mounted in a molded plastic baffle assembly that optimizes the discharge characteristics and sheet handling.

U.S. Pat. No. 4,771,360 describes a grounding brush which electrically grounds a component. The grounding brush is manufactured by forming a plurality of spaced brushes on a support. The support is designed to have regions of reduced thickness between adjacent brushes to facilitate the breaking thereof. Individual brushes are positioned in contact with rollers to electrically ground the rollers.

In accordance with one aspect of the present invention, there is provided a device for electrically grounding a rotating shaft. The device includes an electrically grounded member. Electrically conductive means, mounted removably on the shaft and rotating therewith, periodicaly contacts the grounded member. In this way, the rotating shaft is periodically electrically grounded.

Pursuant to another aspect of the features of the present invention, there is provided an electrophotographic printing machine of the type having a device for electrically grounding at least one rotating shaft employed therein. The printing machine includes an electrically grounded member. Electrically conductive means, mounted removably on the shaft and rotating therewith, periodically contacts the grounded member. In this way, the rotating shaft is periodically electrically grounded.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

Figure 1:
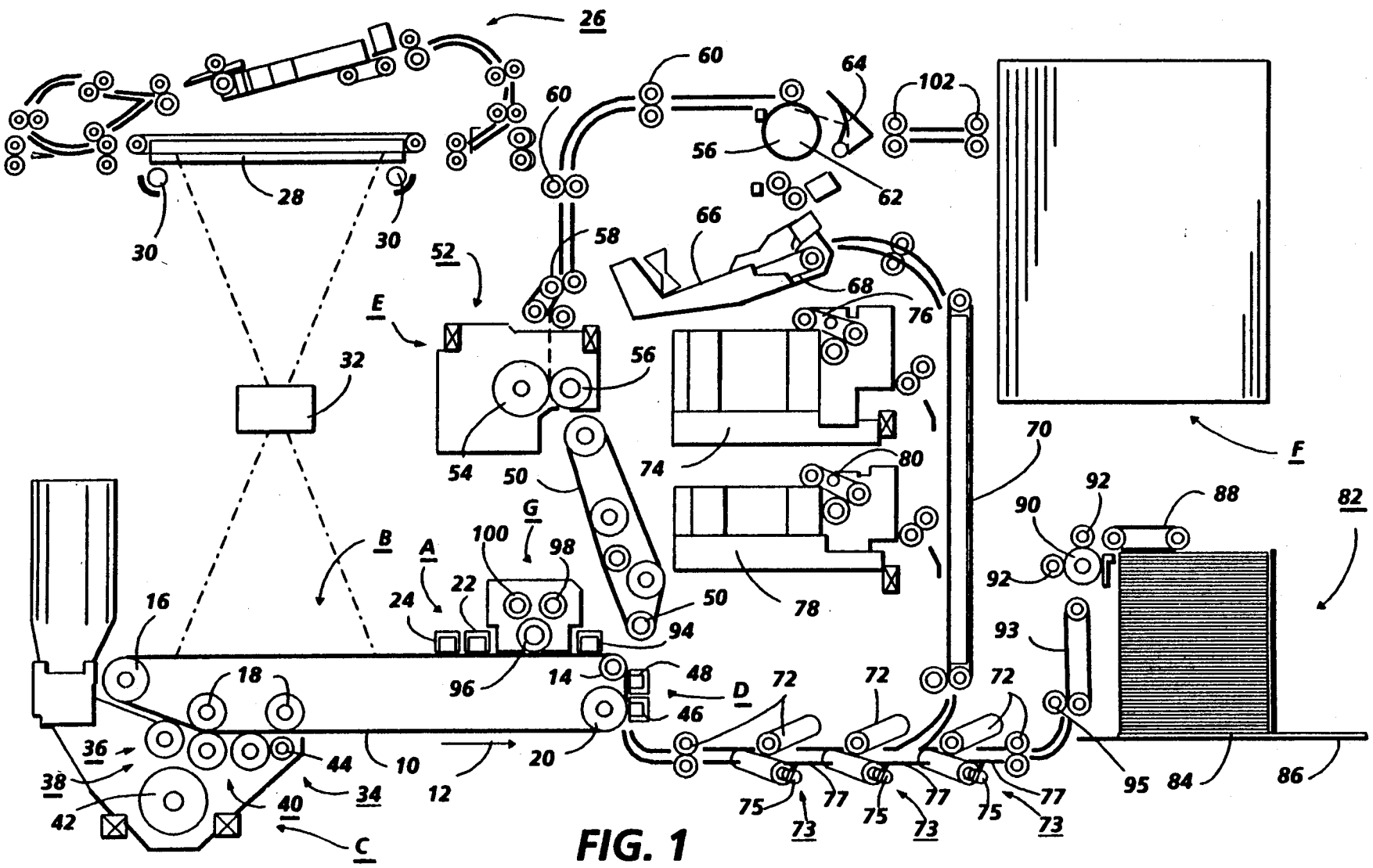
FIG. 1 is a schematic elevational view depicting an illustrative electrophotographic printing machine incorporating the electrical grounding brush of the present invention therein.

For a general understanding of the features of the present invention, reference is made to the drawings. In the drawings, like reference numerals have been used throughout to identify identical elements. FIG. 1 schematically depicts an illustrative electrophotographic printing machine incorporating the features of the present invention therein. It will become evident from the following discussion that the electrical grounding device of the present invention may be employed in a wide variety of devices and is not specifically limited in its application to the particular embodiment depicted herein.

Referring to FIG. 1 of the drawings, the electrophotographic printing machine employs a belt 10 having a photoconductive surface deposited on a conductive substrate. Preferably, the photoconductive surface is made from a selenium alloy with the conductive substrate being made from an aluminum alloy. Other suitable photoconductive materials and conductive substrates may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18 and drive roller 20. Stripping roller 14 is mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surface passes through charging station A. At charging station A, corona generators 22 and 24 charge photoconductive surface 12 to a relatively high, substantially uniform potential.

Next, the charged portion of the photoconductive surface is advanced through imaging station B. At imaging station B, a document handling unit, indicated generally by the reference numeral 26, is positioned over platen 28 of the printing machine. Document handling unit 26 sequentially feeds documents from a stack of documents placed by the operator face up in a normal forward collated order in the document stacking and holding tray. A document feeder located below the tray forwards the bottom document in the stack to a pair of take-away rollers. The bottom document is then fed by the rollers through a document guide to a feed roll pair and belt. The belt advances the document to platen 28. After imaging, the original document is fed from platen 28 by the belt into a guide and feed roll pair. The document then advances into an inverter mechanism and back to the document stack through the feed roll pair. A position gate is provided to divert the document to the inverter or to the feed roll pair. Imaging of a document is achieved by lamps 30 which illuminate the document on platen 28. Light rays reflected from the document are transmitted through lens 32. Lens 32 focuses light images of the original document onto the charged portion of the photoconductive surface of belt 10 to selectively dissipate the charge thereon. This records an electrostatic latent image on photoconductive surface 12 which corresponds to the informational areas contained within the original document. Thereafter, belt 10 advances the electrostatic latent image recorded on the photoconductive surface to development station C.

At development station C, a developer unit, indicated generally by the reference numeral 34, has magnetic brush developer rollers, indicated generally by the reference numerals 36, 38 and 40, which advance developer material into contact with the electrostatic latent image. Paddle wheel 42 advances developer material from the sump of the developer material housing to the developer rollers. The latent image attracts toner particles from the carrier granules of the developer material to form a toner powder image on the photoconductive surface of belt 10. A magnetic scavenging roller 44 removes the extraneous magnetic particles from belt 10. Belt 10 then advances the toner powder image to transfer station D.

At transfer station D, a copy sheet is moved into contact with the toner powder image. Transfer station D includes a corona generator 46 which sprays ions onto the backside of the copy sheet. This attracts the toner powder image from the photoconductive surface. After transfer, corona generator 48 neutralizes the charge on the copy sheet and conveyor 50 advances the copy sheet to fusing station E.

Fusing station E includes a fuser assembly, indicated generally by the reference numeral 52 which permanently affixes the transferred toner powder image to the copy sheet. Preferably, fuser assembly 52 includes a heated fuser roller 54 and a back-up roller 56 with the powder image on the copy sheet contacting fuser roller 54. In this manner, the powder image is permanently affixed to the copy sheet.

After fusing, the copy sheets are fed through decurler 58 to forwarding rollers 60. Forwarding rollers 60 advance the sheet to duplex inverter roller 62 and gate 64 which function as an inverter selector. Depending upon the position of gate 64, the copy sheets are deflected to roller 62 or bypass roller 62 and are fed directly to feed rollers 102 which advance the sheet to finishing station F. If the inverter path is selected, the opposite is true, the copy sheet is diverted onto inverter roller 62, roll 62 inverts and stacks the sheets to be duplexed in duplex tray 66. Duplex tray 66 provides an intermediate or buffer storage for those sheets that have been printed on one side and on which an image will be subsequently printed on the second, opposed side thereof, i.e. the sheets being duplexed. The sheets are stacked in the duplex tray face down on top of one another in the order in which they are copied.

In order to complete duplex copying, the simplex sheets in tray 66 are fed, in seriatim, by bottom feeder 68 from tray 66 back to transfer station D via conveyors 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be to be advanced to the finishing station.

Copy sheets are fed to transfer station D from the secondary tray 74. The secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to conveyor 70 which advances the sheets to rolls 72 and then to transfer station D.

Secondary tray 74 and auxiliary tray 78 are secondary souces of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away drive roll 90 and idler rolls 92. The drive roll and idler rolls guide the sheet onto transport 93. Transport 93 and idler roll 95 advance the sheet to rolls 72 which, in turn, move the sheet to transfer station station D.

A grounding brush, indicated generally by the reference numeral 73, incorporating the features of the present invention, is mounted on the shafts of the various rolls of the printing machine. As an example, grounding brush 73 is shown mounted on shaft 75 of rolls 72 contacting periodically sheet guide plate or baffle 77. However, in actual practice, grounding brush 73 will be mounted on all of the appropriate shafts in the printing machine. Thus, not only will grounding brush 73 electrically ground the drive rollers and shafts associated with the copy sheet drive systems, but also those associated with the original document handling system, i.e. document handling system 26. The sheet guide plate or baffle associated with each grounding brush is mounted on the electrically grounded machine frame with the brush extending outwardly from the appropriate shaft to rotate in contact therewith periodically.

With continued reference to FIG. 1, invariably, after the copy sheet is separated from the photoconductive surface of belt 10, some residual particles remain adhering thereto. These residual particles are removed from the photoconductive surface at cleaning station G. After transfer, photoconductive belt 10 passes beneath corona generating device 94 which charges the residual toner particles to the proper polarity. Thereafter, a precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the decision gates depending upon the mode of operation selected. The detailed operation and construction of grounding brush 74 will be described hereinafter with reference to FIGS. 2 and 3.

Figure 2:
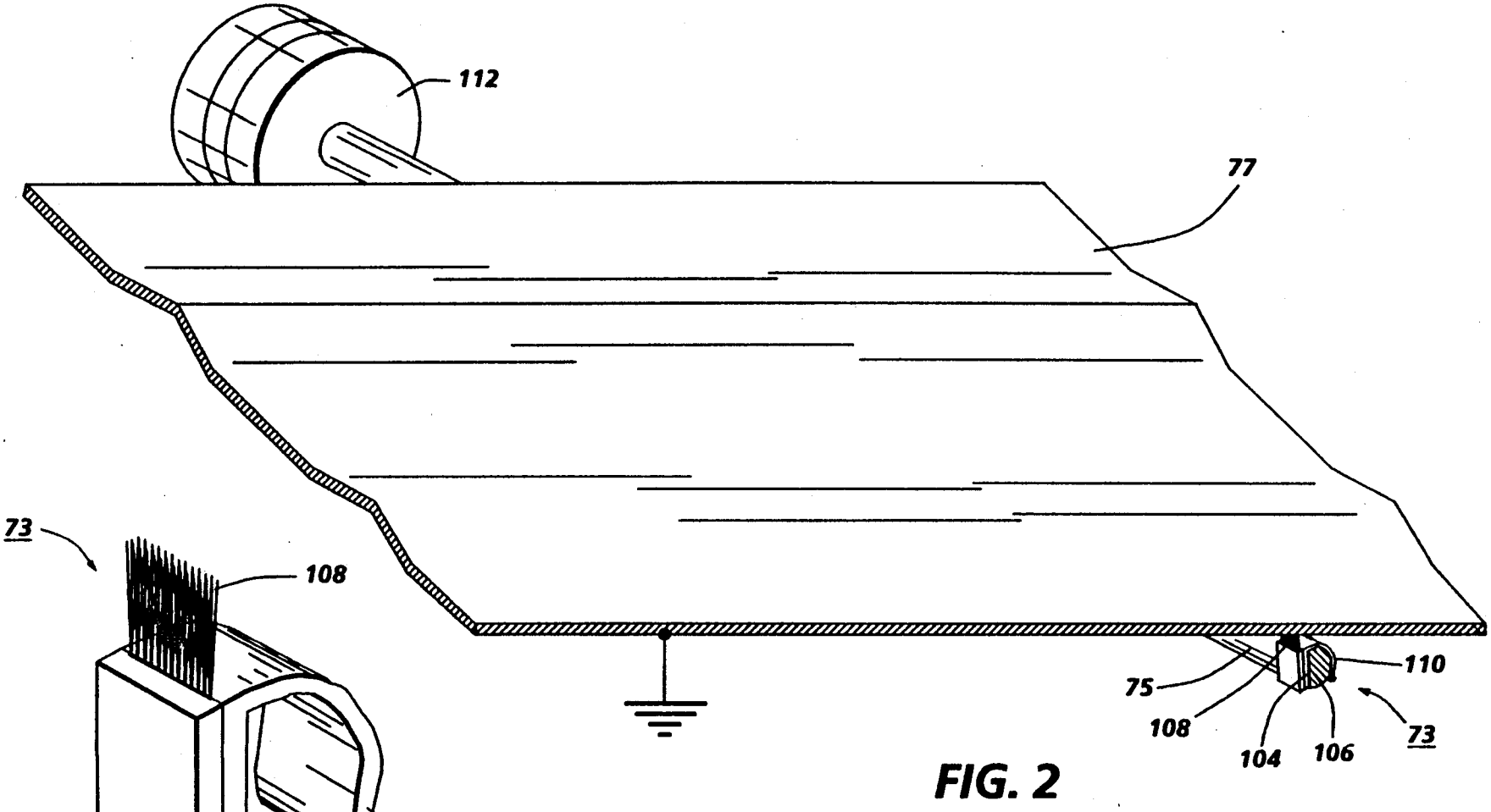
FIG. 2 is a schematic perspective view showing the electrical grounding brush mounted on a rotating shaft used in the FIG. 1 printing machine.

Referring now to FIG. 2, grounding brush 73 is mounted removably on shaft 75. Shaft 75 has a semi-circular cross section with a flat surface machined thereon. The grounding brush 73 clips on to the shaft 75 with leg 104 of brush 73 being in contact with the flat surface 106 of shaft 75. In this way, brush 73 rotates with shaft 75. Shaft 75 is coupled to motor 112. Motor 112 rotates shaft 75 and brush 73. Electrically conductive fibers 108 extend outwardly from support 110 of brush 73. As brush 73 rotates with shaft 75, fibers 108 periodically contact guide plate 77. Guide plate 77 is electrically grounded. When fibers 108 contact plate 77, a ground path is formed to electrically ground shaft 75 and any roller mounted thereon.

Figure 3:
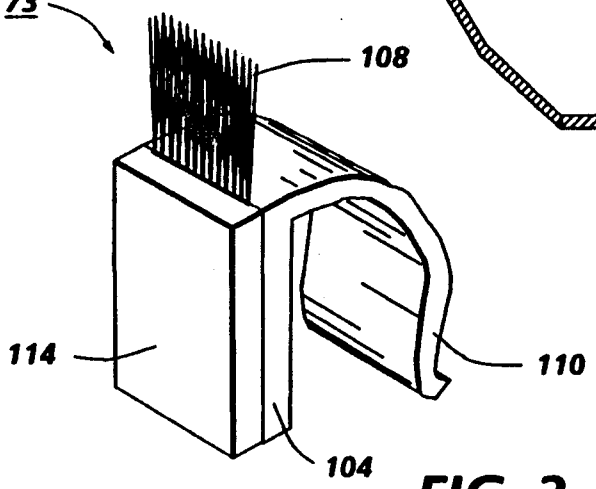
FIG. 3 is an elevational view depicting the FIG. 2 brush mounted on the rotating shaft.

Turning now to FIG. 3, grounding brush 73 includes a support 110 having a bundle of fibers 108 extending outwardly therefrom. Support 110 is configured in the shape of an arch with leg 104 being substantially planar or flat. The bundle of fibers 108 includes from fifty to one thousand fibers. Each fiber has a diameter ranging from about five to about fifty microns. The fibers are electrically conductive and mounted on support 110 to have a free end extending outwardly therefrom. In this way, when the brush is clipped on shaft 75, the the fibers will periodically contact plate 77 as shaft 75 rotates. The fibers extend outwardly from support 110 over an effective length of about twelve millimeters, and exhibit a sufficient resiliency and stiffness, as well as high wear resistance to be used for a long period of time without distortion or deflection to preserve an excellent electrical discharging performance over extended periods of time. Preferably, the fibers are made from stainless steel or carbon. Support 110 is made from an electrically conductive plastic material. Preferably, support 110 is made from a conductive resin containing conductive particles. Support 110 is resilient and is mounted slidably on shaft 75 with leg 104 being on flat surface 106 of shaft 75. Support 110 is secured frictionally on shaft 75 and rotates in unison therewith. One skilled in the art will appreciate that the the length of fibers 108 is user selectable and a function of the space between shaft 75 and plate 77. The length of fibers 108 is selected such that they periodically contact plate 77 as shaft 75 rotates. Grounding brush 73 is constructed with support 110 having a flat planar leg or member 104 and a flat planar member 114 opposed therefrom. The bundle of fibers 108 is positioned or sandwiched between members 104 and 114. Members 104 and 114 are secured to one another and fibers 108 by ultrasonic welding. Alternatively, members 104 and 114 may be secured to one another and fibers 108 by an electrically conductive adhesive, such as a graphite filled epoxy in a toluene xylene solvent made by Acheson Colloids Company of Port Huron, Mich. as Electrodag 213.

In recapitulation, the grounding brush of the present invention includes a bundle of electrically conductive fibers extending outwardly from an electrically conductive support. The support is mounted on a shaft. As the shaft rotates, the fibers of the brush periodically contact an electrically grounded plate. This forms an electrical grounding path which grounds the rotating shaft and any rollers mounted thereon. A grounding brush constructed in this manner is significantly less expensive to assemble and maintain in a printing machine than grounding devices heretofore constructed in a conventional manner.

It is, therefore, evident that there has been provided, in accordance with the present invention, a grounding device that fully satisfies the aims and advantages hereinbefore set forth. While this invention has been described in conjunction with a preferred embodiment thereof, it is evident that many alternatives, modifications, and variations will be apparent to those skilled in the art. Accordingly, it is intended to embrace all such alternatives, modifications and variations as fall within the spirit and broad scope of the appended claims.

We claim:

1. A device for electrically conductive rotating shaft, including:

an electrically grounded member;

electrically conductive means, mounted removably on the shaft and rotating therewith to periodically contact said grounded member, for periodically electrically grounding the rotating shaft.

2. A device according to claim 1, wherein said grounding means includes:

an electrically conductive support member adapted to be mounted removably on the shaft to rotate in unison therewith; and a multiplicity of electrically conductive fibers secured to said support member and extending outwardly therefrom, said fibers being of a length such that the free end thereof periodically contacts said grounded member during the rotation of the shaft.

3. A device according to claim 2, wherein said support member is adapted to be mounted slidably on the rotating shaft.

4. A device according to claim 3, wherein said support member is frictionally secured to the rotating shaft.

5. A device according to claim 4, wherein said support member is configured in the shape of an arch and being made from a resilient material.

6. An electrophotographic printing machine of the type having a device for electrically grounding at least one rotating shaft employed therein, including an electrically grounded member;

electrically conductive means, mounted removably on the shaft and rotating therewith to periodically contact said grounded member, for periodically electrically grounding the rotating shaft.

7. A printing machine according to claim 6, wherein said conductive means includes:

an electrically conductive support member adapted to be mounted removably on the shaft to rotate in unison therewith; and a multiplicity of electrically conductive fibers secured to said support member and extending outwardly therefrom, said fibers being of a length such that the free end thereof periodically contacts said grounded member during the rotation of the shaft.

8. A printing machine according to claim 7, wherein said support member is adapted to be mounted slidably on the rotating shaft.

9. A printing machine according to claim 8, wherein said support member is frictionally secured to the rotating shaft.

10. A printing machine according to claim 9, wherein said support member is configured in the shape of an arch and being made from a resilient material.

* * * * *